US008270881B2

(12) United States Patent
Kim

(10) Patent No.: US 8,270,881 B2
(45) Date of Patent: Sep. 18, 2012

(54) IMAGE FORMING APPARATUS AND CONTROL METHOD THEREOF

(75) Inventor: Dae Ho Kim, Euiwang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 124 days.

(21) Appl. No.: 12/691,030

(22) Filed: Jan. 21, 2010

(65) Prior Publication Data

US 2010/0189455 A1 Jul. 29, 2010

(30) Foreign Application Priority Data

Jan. 23, 2009 (KR) ..... 10-2009-0006145

(51) Int. Cl.
*G03G 15/08* (2006.01)

(52) U.S. Cl. ..... 399/254; 399/256

(58) Field of Classification Search ..... 399/167, 399/254, 256, 263
See application file for complete search history.

(56) References Cited

FOREIGN PATENT DOCUMENTS

JP 2008-134319 6/2008

*Primary Examiner* — Hoang Ngo
(74) *Attorney, Agent, or Firm* — Stanzione & Kim, LLP

(57) ABSTRACT

An image forming apparatus and a control method thereof provides that when circulation of developer in a housing of a developing unit is deteriorated due to concentration of the developer, thus applying increased load to an agitator, the agitator is appropriately rotated forwardly and backwardly under the control of a controller. This may prevent overloading of the agitator and release the concentrated developer.

20 Claims, 12 Drawing Sheets

$T_f1 < T_f2 < T_f3 \cdots < T_fn$ $T_r1 < T_r2 < T_r3 \cdots < T_rn$ $T_f \neq T_r$ $\theta_f1 < \theta_f2 < \theta_f3 \cdots < \theta_fn$ $\theta_r1 < \theta_r2 < \theta_r3 \cdots < \theta_rn$ $\theta_f = \theta_r$ $\theta_f1 < \theta_f2 < \theta_f3 \cdots < \theta_fn$ $\theta_r1 < \theta_r2 < \theta_r3 \cdots < \theta_rn$ $\theta_f \neq \theta_r$

IMAGE FORMING APPARATUS AND CONTROL METHOD THEREOF

CROSS-REFERENCE TO RELATED APPLICATIONS

This application claims priority under 35 U.S.C. §119(a) from Korean Patent Application No. 2009-0006145, filed on Jan. 23, 2009 in the Korean Intellectual Property Office, the disclosure of which is incorporated herein by reference in its entirety.

BACKGROUND

1. Field of the Invention

The present general inventive concept relates to an image forming apparatus and a control method thereof to control rotation of an agitator used to feed developer into a developing region of the image forming apparatus.

2. Description of the Related Art

Generally, image forming apparatuses are devised to develop a black-and-white image or color image on a printing medium, such as paper, according to image signals. Examples of image forming apparatuses include Light Emitting Diode (LED) printers, laser printers, inkjet printers, copiers, facsimiles, and so-called multi-functional devices that combine some of the functionalities of the aforementioned devices.

In an electro-photographic image forming apparatus as a kind of the aforementioned image forming apparatuses, after a surface of a photoconductor is charged by an electric potential or is subjected to a cleaning operation, developer is attached to a region resulting from an electric potential difference on the surface of the photoconductor to form a visible image. The visible developer image, formed on the photoconductor, is transferred to a printing medium, and thereafter is fused to a surface of the printing medium upon receiving heat and pressure.

Developer used for image development may be classified into single component developers and binary developers. In the case of single component developers, after toner particles are charged by friction therebetween or friction with another charging member, the charged toner particles are delivered to a developing roller, and then are attached to the photoconductor. Binary developer is prepared by mixing a magnetic carrier and a non-magnetic synthetic resin toner at an appropriate mixing ratio. Toner particles are charged upon mixing with carrier particles and are delivered to a magnetic roller together with the carrier particles to thereby be attached to the photoconductor.

A developing unit using binary developer receives toner from a toner feed vessel replaceably mounted in a body of the image forming apparatus. Toner particles fed from the toner feed vessel are mixed with carrier particles by an agitator provided in a housing of the developing unit and are charged with a polarity opposite to the carrier particles. The agitator includes a pair of augers. A first one of the pair of augers delivers newly fed toner particles in a given direction to mix the toner particles with the carrier particles and electrically charge the toner particles. A second auger is spaced apart from the magnetic roller with a predetermined gap and delivers the mixed developer in an opposite direction to uniformly feed the developer throughout a surface of the magnetic roller.

The housing of the developing unit is divided into a first agitation space in which the first auger is rotatably provided, and a second agitation space in which the second auger is rotatably provided. The two agitation spaces are connected to each other through two gates defined in opposite sides of the housing. Thus, the developer is fed to the magnetic roller while circulating in the two agitation spaces.

However, if the developing unit is tilted during transportation or storage thereof, or if vibration or irregular operation of the two augers occurs, the developer may be concentrated on one of the gates. This may prevent the developer from being smoothly delivered through the gates when the developer unit is initially operated after installation thereof. As a result, the gates may undergo increased developer delivery pressure and the rotating augers may exhibit significantly increased torque. Such a pressure or torque increase may damage, e.g., a drive motor provided in a body of the image forming apparatus as well as constituent elements of the developing unit, such as the augers, housing, and other components of the developing unit.

SUMMARY

The present general inventive concept provides an image forming apparatus and a control method thereof, which may effectively release developer from a gate when the developer circulating in a housing of a developing unit is concentrated on the gate, and thus may reduce damage to constituent elements of the developing unit.

Additional features and utilities of the present general inventive concept will be set forth in part in the description which follows and, in part, will be obvious from the description, or may be learned by practice of embodiments of the general inventive concept.

Exemplary embodiments of the present general inventive concept may be achieved by providing an image forming apparatus including a housing in which an agitation space for agitation of a developer is defined, an agitator rotatably provided in the agitation space to deliver the developer, a developing device to feed the developer delivered by the agitator to a photoconductor, a drive source to rotate the agitator, and a controller to control the drive source in a forward rotation and a backward rotation.

The controller may controls the forward rotation of the agitator a different number of times from the backward rotation of the agitator at the initial operation time of the housing.

The controller may control repeated implementation of the forward and backward rotation such that at least one of a rotation speed, a rotation time and a rotation angle of at least one of the forward rotation and backward rotation is changed.

The controller may control repeated implementation of the forward and backward rotation such that at least one of a rotation speed, a rotation time and a rotation angle of at least one of the forward rotation and backward rotation is changed, causing an increase in the rotation speed, rotation time, or rotation angle as time passes.

The controller may control repeated implementation of the forward and backward rotation such that at least one of a rotation speed, a rotation time and a rotation angle of at least one of the forward rotation and backward rotation is changed at different rates with respect to the forward rotation and the backward rotation.

The initial operation time may be at least one of a time when the housing is initially installed into the image forming apparatus, a time when the agitator is initially rotated after separation and reinstallation of the housing, and a previous operation time for a print operation in response to a print command transmitted to the image forming apparatus.

The initial operation time is determined via information stored in a memory device of the housing or of the image forming apparatus.

The agitator may be configured into a shape including at least one of a spiral screw shape, a shape including at least one rotator in the form of a plate, a shape including at least one rotator in the form of a blade, or a hollow tube shape.

Exemplary embodiments of the present general inventive concept may also be achieved by providing a control method of an image forming apparatus including a housing in which an agitation space for agitation of developer is defined, an agitator rotatably provided in the agitation space to deliver the developer, and a developing device to feed the developer delivered by the agitator to a photoconductor, the control method including determining whether or not the housing is initially operated, and implementing a forward and backward rotation of the agitator if the initial operation of the housing is determined.

The implementation of the forward and backward rotation of the agitator may include rotating the agitator forwardly and backwardly respectively one or more times.

The implementation of the forward and backward rotation of the agitator may include controlling the forward rotation a different number of times from the backward rotation.

The implementation of the forward and backward rotation of the agitator may include controlling repeated implementation of the forward and backward rotation such that at least one of a rotation speed, a rotation time and a rotation angle of at least one of the forward rotation and backward rotation is changed.

The implementation of the forward and backward rotation of the agitator may include controlling repeated implementation of the forward and backward rotation such that at least one of a rotation speed, a rotation time and a rotation angle of at least one of the forward rotation and backward rotation is changed, causing an increase in the rotation speed, rotation time, or rotation angle as time passes.

The implementation of the forward and backward rotation of the agitator may include controlling repeated implementation of the forward and backward rotation such that at least one of a rotation speed, a rotation time and a rotation angle of at least one of the forward rotation and backward rotation is changed at different rates with respect to the forward rotation and the backward rotation.

The initial operation time of the housing may be at least one of a time when the housing is initially installed into the image forming apparatus, a time when the agitator is initially rotated after separation and reinstallation of the housing, and a previous operation time for a print operation in response to a print command transmitted to the image forming apparatus.

The initial operation time may be determined via information stored in a memory device of the housing or of the image forming apparatus.

Exemplary embodiments of the present general inventive concept may also be achieved by providing a cartridge, provided in an image forming apparatus to form an image and having a drive source, including a an agitation space to receive a developer, and an agitator provided in the agitation space to agitate the developer, and the agitator is operated by the drive source to implement a forward and backward rotation.

The cartridge may further include a developing device to which the developer agitated by the agitator is fed, and a photoconductor to which the developer is fed by the developing device.

The agitator may be rotated forwardly and backwardly respectively one or more times upon an initial operation of the cartridge.

The forward rotation and the backward rotation may be performed a different number of times from each other upon the initial operation of the cartridge.

The forward and backward rotation may be repeated such that at least one of a rotation speed, a rotation time and a rotation angle of at least one of the forward rotation and backward rotation is changed.

Exemplary embodiments of the present general inventive concept may also be achieved by providing a method of controlling a developing unit of an image forming apparatus, the developing unit having an agitator rotatably installed therein to agitate a developer, the method including rotating the agitator in a forward and backward direction to release a developer concentrated in the developing unit according to a determined operation time of the developing unit.

The determined operation time may be at least one of an initial installation of the developing unit in the image forming apparatus, an installation of the developing unit into the image forming apparatus after a separation from the image forming apparatus, a period of time since a previous rotation of the agitator in a forward and backward direction, and a period of time since a previous operation of the developing unit.

The agitator may include a pair of augers to agitate the developer.

The forward and backward rotation of the agitator may be repeated a predetermined number of times.

The forward rotation may be performed at least one of for a different rotation time, at a different rotation angle, or at a different rotation speed, than the backward rotation.

The at least one of the rotation time, the rotation angle and the speed may be increased over time.

Exemplary embodiments of the present general inventive concept may also be achieved by providing an image forming apparatus, including a drive source to rotate an agitator of a cartridge, and a controller to control the drive source to rotate the agitator in a forward rotation and a backward rotation.

Exemplary embodiments of the present general inventive concept may also be achieved by providing an image forming apparatus, including a cartridge provided in the image forming apparatus to form an image, the cartridge comprising an agitation space to receive a developer and an agitator provided in the agitation space to agitate the developer, a drive source to rotate the agitator, and a controller to control the drive source to rotate the agitator in a forward rotation and a backward rotation.

BRIEF DESCRIPTION OF THE DRAWINGS

These and/or other features and utilities of the present general inventive concept will become apparent and more readily appreciated from the following description of certain exemplary embodiments, taken in conjunction with the accompanying drawings of which.

DETAILED DESCRIPTION OF THE EMBODIMENTS

Figure 1:
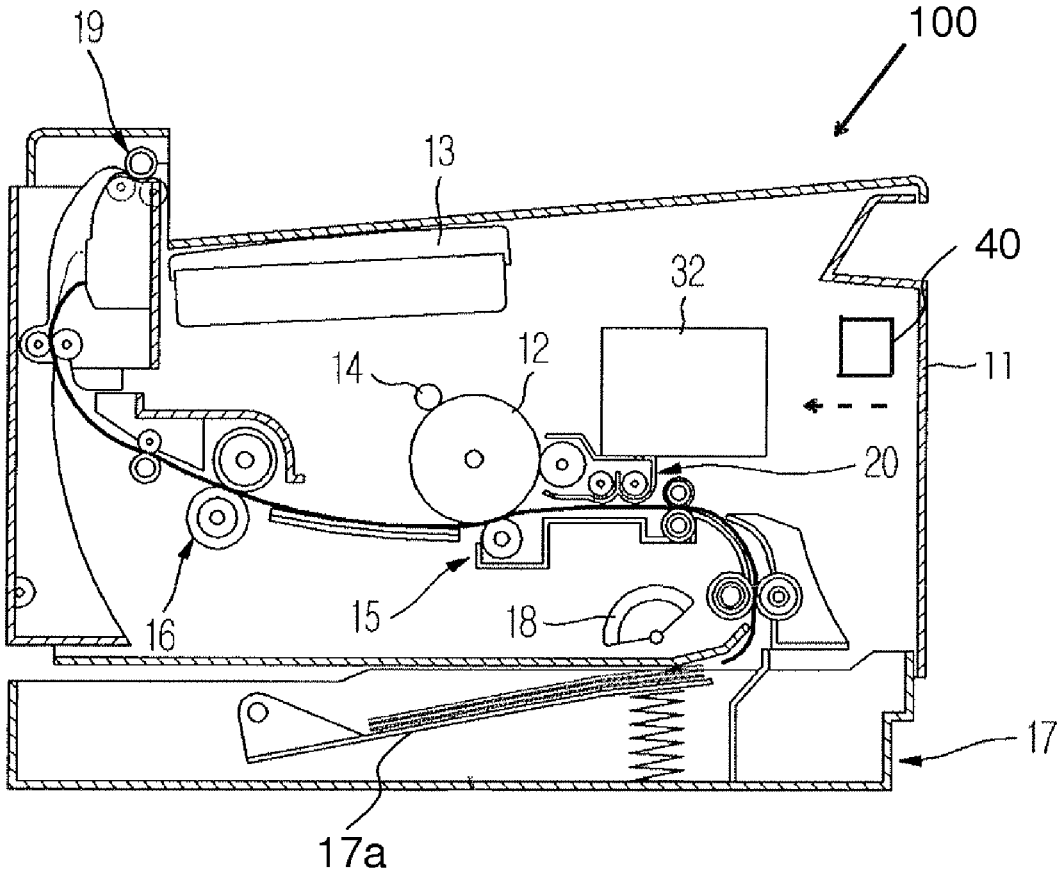
FIG. 1 is a schematic configuration view illustrating an image forming apparatus according to an exemplary embodiment of the present general inventive concept.

Reference will now be made in detail to exemplary embodiments of the present general inventive concept, examples of which are illustrated in the accompanying drawings, wherein like reference numerals refer to like elements throughout.

FIG. 1 is a schematic configuration view illustrating an image forming apparatus 100 according to an exemplary embodiment of the present general inventive concept.

As illustrated in FIG. 1, the image forming apparatus 100 according to an exemplary embodiment includes a body 11 to define an exterior appearance of the image forming apparatus 100, a photoconductor 12 on which an electrostatic latent image is formed, a light scanning unit 13 to scan the photoconductor 12 with a light beam, a charging unit 14 to charge the photoconductor 12 with a predetermined electric potential, a developing unit 20 to attach toner as developer to the photoconductor 12 on which the electrostatic latent image is previously formed so as to form a visible image, a transfer unit 15 to transfer the visible image formed on the photoconductor 12 to a printing medium 17*a*, and a fusing unit 16 to fuse the visible image in a powdered state to a surface of the printing medium by applying heat and pressure to the printing medium 17*a*.

In addition, provided in the body 11 of the image forming apparatus 100 are a printing medium supply unit 17 detachably coupled to the bottom of the body 11, a pickup device 18 to pick up printing media 17*a* stacked in the printing medium supply unit 17 sheet by sheet, and a printing medium discharge unit 19 to discharge the printing medium 17*a*, on which a printing operation has been completed, to the outside of the body 11 of the image forming apparatus. The operations of the photoconductor 12, the light scanning unit 13, the charging unit 14, the transfer unit 15, the fusing unit 16, and printing medium supply unit 17, the pickup device 18, the discharge unit 19 and the developing unit 20 can be controller by signals from a controller 40.

In the image forming apparatus according to en exemplary embodiment of the present general inventive concept, if a printing operation is initiated, the pickup device 18 is operated to pick up a printing medium 17*a* stacked in the printing medium supply unit 17 sheet by sheet and to deliver the picked-up printing medium 17*a* to the developing unit 20. The light scanning unit 13 scans the surface of the photoconductor 12, which is previously charged with a predetermined electric potential, with a light beam based on image signals, thus forming an electrostatic latent image on the surface of the photoconductor 12. Thereafter, toner particles as developer are attached to the electrostatic latent image on the surface of the photoconductor 12 to form a visible image in a powdered state. The visible image is transferred to a surface of the delivered printing medium 17*a* by the transfer unit 15. The visible image transferred to the printing medium 17*a* is fused to the surface of the printing medium 17*a* upon receiving heat and pressure when the printing medium passes through the fusing unit 16. The printing medium 17*a*, having passed through the fusing unit 16, is discharged to the outside of the body 11 of the image forming apparatus by the printing medium discharge unit 19.

The aforementioned constituent elements of the image forming apparatus 100 according to an exemplary embodiment of the present general inventive concept except for the developing unit 20 are identical to conventional ones and thus, a detailed description thereof will be omitted.

The image forming apparatus 100 according to an exemplary embodiment of the present general inventive concept is of a binary developer type using toner and carrier.

Although binary developer consisting of toner and carrier is described in an exemplary embodiment, this is not a limitation, and, for example, other forms of developer, such as single component developer, may also be used.

In addition, although in an exemplary embodiment the pair of augers is described as an agitator, this is not a limitation, and other shapes of agitators for agitation and feeding of developer, such as, e.g., rotary type agitators, as well as coils and stirrers, may also be used. Moreover, although an exemplary configuration illustrated in FIG. 2 wherein a spiral blade is installed around an entire center shaft may be possible, in an alternative exemplary agitator configuration, a delivery blade may be provided at an inner periphery of a hollow tube. In another alternative exemplary agitator configuration, a single or a plurality of blades or plates made of, for example, rubber or film material, may extend from a center shaft in a rotating direction.

Figure 2:
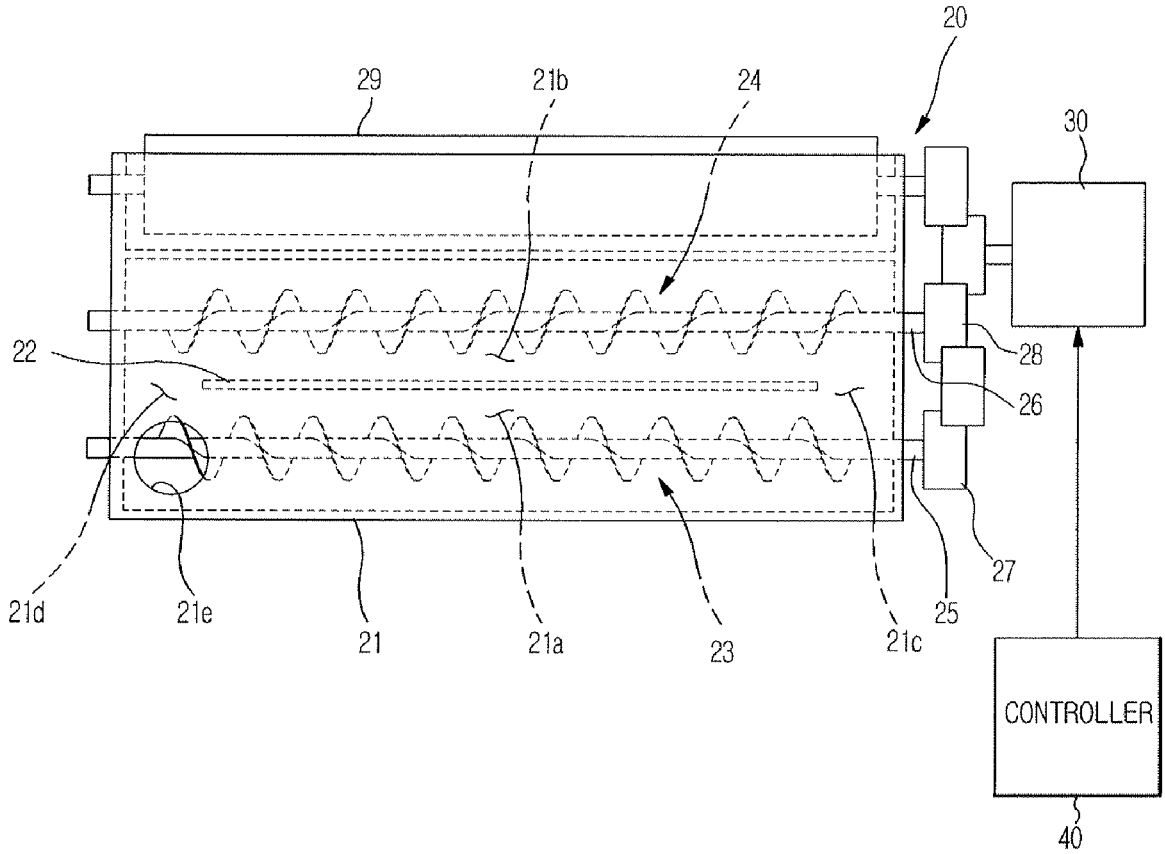
FIG. 2 is a schematic configuration view illustrating a developing unit of the image forming apparatus according to an exemplary embodiment of the present general inventive concept.

FIG. 2 is a schematic configuration view illustrating a developing unit 20 of the image forming apparatus 100 according to an exemplary embodiment of the present general inventive concept. Referring to FIG. 2, the developing unit 20 used to form the visible image on the photoconductor 12 includes a housing 21 in which an agitation space of toner and carrier is defined, a pair of augers 23 and 24 constituting an agitator rotatably provided in the housing 21, and a magnetic roller 29 to attach the toner to the surface of the photoconductor 12 upon receiving the developer fed by the pair of augers 23 and 24. In an exemplary embodiment, the pair of augers 23 and 24 can be implemented as spiral screws.

As illustrated in FIG. 2, the interior of the housing 21 is divided into a first agitation space 21*a* for agitation of the developer and a second agitation space 21*b* for feeding of the agitated developer to the magnetic roller 29 by a partition 22. A length of the partition 22 is shorter than a length of the interior of the housing 21, and thus provides open spaces between ends of the partition 22 and the interior surface of the housing 21 in opposite sides of the housing 21. Thereby, first and second gates 21*c* and 21*d* are defined in the opposite sides of the housing 21 and serve to connect the first agitation space 21*a* and second agitation space 21*b* to each other. In an exemplary embodiment, a toner feed hole 21*e* can be provided in one side of an upper surface of the housing 21 near the second gate 21*d*. However, this is not a limitation, and the toner feed hole 21*e* can be provided at any portion of the housing to supply toner in accordance with the present general inventive concept. Toner stored in a toner feed vessel 32 (see FIG. 1) is fed into the housing 21 through the toner feed hole 21*d*.

The first auger 23 is rotatably provided in the first agitation space 21*a* and the second auger 24 is rotatably provided in the second agitation space 21*b*. The first auger 23 is rotated upon receiving drive force from an external drive source 30 and can deliver new developer fed through the toner feed hole 21*e* and the developer delivered through the second gate 21*d* toward the first gate 21*c*.

The toner delivered by the first auger 23 is charged while being mixed with carrier in the first agitation space 21*a*. The developer delivered to the first gate 21*c* can be pushed by the first auger 23 to thereby be delivered into the second agitation space 21*b* through the first gate 21*c*.

The second auger 24 is also rotated upon receiving the drive force from the external drive source 30, and can deliver the developer received through the first gate 21*c* toward the second gate 21*d*. A part of the developer delivered by the second auger 24 is attached to the magnetic roller 29 in the second agitation space 21*b*. Similar to the first agitation space 21*a*, mixing and charging of the toner are implemented even while the developer is delivered by the second auger 24 in the second agitation space 21*b*. The developer delivered from the second agitation space 21*b* to the second gate 21*d* can be pushed by the second auger 24 to thereby be again delivered into the first agitation space 21*a* through the second gate 21*d*. Thereby, the developer can be circulated in a counter-clockwise direction. Here, the drive source 30 may include individual drive sources provided respectively to operate the first and second augers 23 and 24, or a single external drive source may transmit a drive force to the respective augers 23 and 24 with the use of a power transmission (for example, an electronic clutch) for interception of the drive force.

The drive source 30 is controlled by a controller 40 that can control the general operations of the image forming apparatus 100. In particular, to prevent the developing unit 20 from suffering from concentration of the developer, the controller 40 can repeat an operation to rotate the first and second augers 23 and 24 forwardly (or backwardly) for a predetermined time, by a predetermined angle, or with a predetermined torque, and thereafter can again rotate the first and second augers 23 and 24 backwardly (or forwardly) for a predetermined time, by a predetermined angle, or with a predetermined torque. This forward and backward rotation may release the concentrated developer, and thus may enable smooth operation of the developing unit 20.

With the rotation of the first and second augers 23 and 24, the developer in the housing 21 can be circulated from the first agitation space 21*a* to the first gate 21*c*, from the first gate 21*c* to the second agitation space 21*b*, from the second agitation space 21*b* to the second gate 21*d*, and from the second gate 21*d* to the first agitation space 21*a*.

The first auger 23 and second auger 24 respectively can include rotating shafts 25 and 26. One end of the rotating shafts 25 and 26 can be provided with gears 27 and 28 to transmit the drive force of the external drive source 30 to the rotating shafts 25 and 26. If the developer is concentrated on any one of the gates 21*c* and 21*d* in the housing 21, the first and second augers 23 and 24 can repeat forward and backward rotation one or more times upon receiving the drive force from the external drive source 30, thereby releasing the concentrated developer. More particularly, if the developer is concentrated in one side of the housing 21, the first and second augers 23 and 24 can undergo an excessive torque upon both forward rotation and backward rotation thereof. In this case, an operation to rotate the first and second augers 23 and 24 forwardly (or backwardly) for a predetermined time, by a predetermined angle, or with a predetermined torque, and thereafter again rotate the first and second augers 23 and 24 backwardly (or forwardly) for a predetermined time, by a predetermined angle, or with a predetermined torque can be repeated. As the forward and backward rotation of the first and second augers 23 and 24 is repeated under the condition of gradually increasing the forward rotation or backward rotation time, angle and/or torque of the first and second augers 23 and 24, the concentrated developer may be released and smooth operation of the developing unit 20 may become possible.

In another example of the forward and backward rotation of the augers 23 and 24, if the forward and backward rotation is repeated two times, at least one of the forward rotation and backward rotation may have a greater rotation time or rotation angle thereof than an initial rotation time or initial rotation angle. Also, if the forward and backward rotation of the augers 23 and 24 is repeated three or more times, at least two of the repeated rotations may have a greater rotation time or rotation angle than an initial rotation time or initial rotation angle, or all three rotations may be gradually increased in rotation time or rotation angle above an initial rotation or initial rotation angle. Of course, the number of the forward rotations may be not equal to the number of backward rotations and any number of forward and backward rotations may be made. For example, three forward rotations and only two backward rotations may be implemented. Other combinations of forward and backward rotations are also possible.

Figure 3:
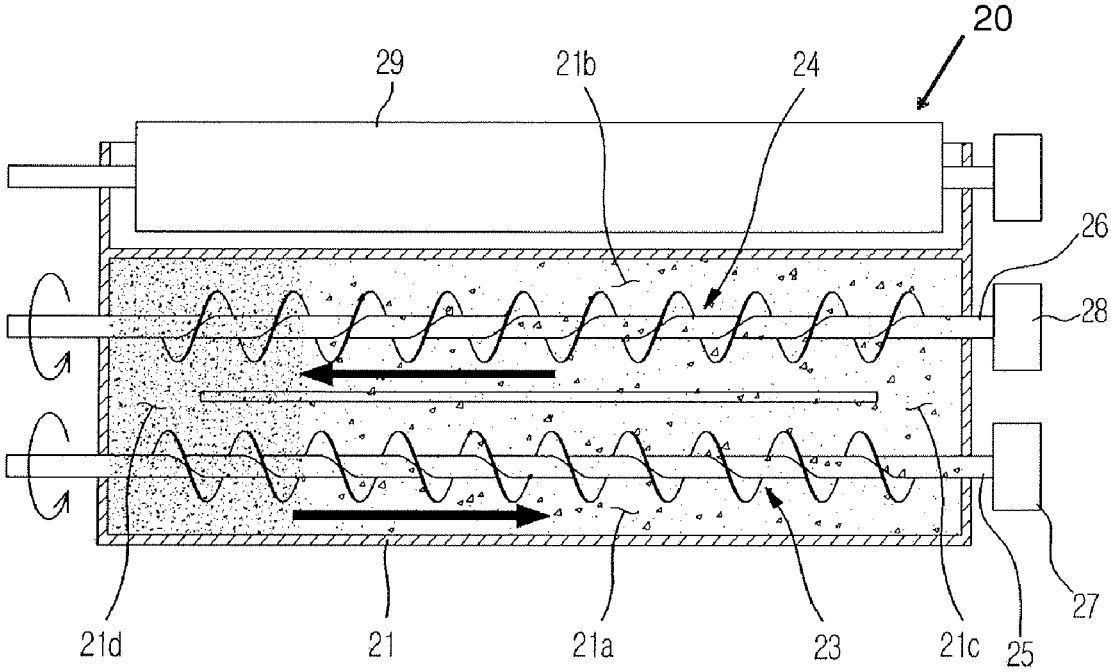
FIGS. 3 and 4 are views illustrating an operation to release developer concentrated on a left gate in the developing unit of the image forming apparatus according to an exemplary embodiment of the present general inventive concept.
Figure 4:
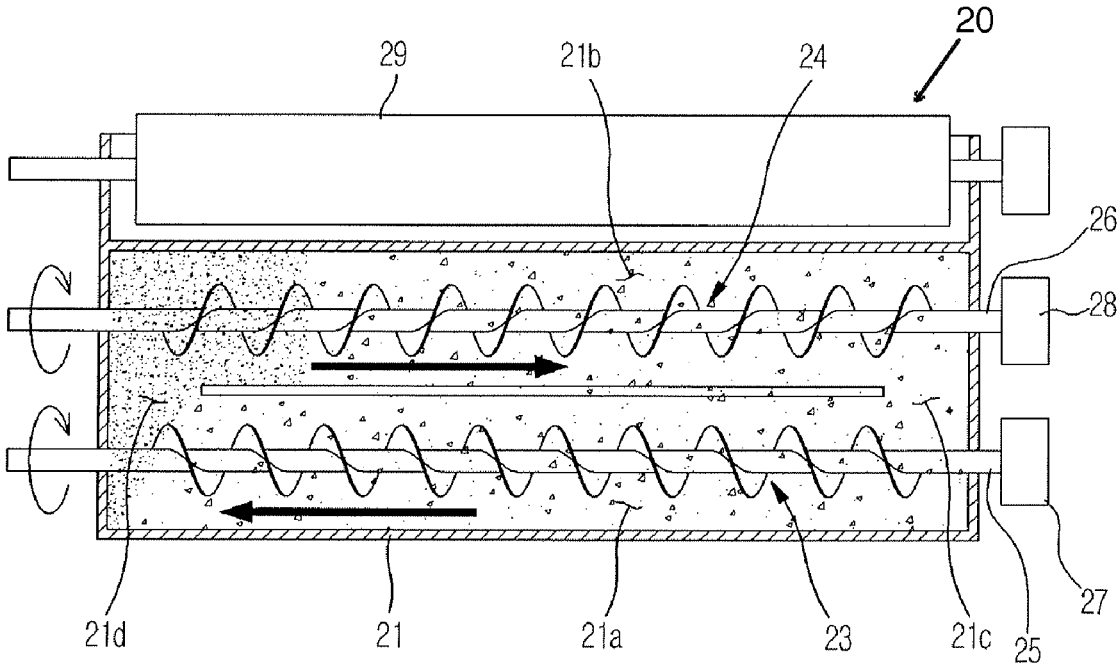

FIGS. 3 and 4 are views illustrating an operation to release developer concentrated on the left gate 21*d* in the developing unit of the image forming apparatus 100 according to an exemplary embodiment of the present general inventive concept.

As illustrated in FIG. 3, if the developing unit 20 is initially operated in a state wherein the developer in the housing 21 is concentrated in the area of the second gate 21*d*, the developer in the second agitation space 21*b* is accumulated rather than smoothly passing through the second gate 21*d*, thus increasing a rotation resistance and torque on the second auger 24 upstream of the second gate 21*d* and consequently, a load on the second auger 24. In this case, repeating an operation to rotate the first and second augers 23 and 24 forwardly and backwardly in sequence may deliver the developer concentrated on the second gate 21*d* in the second agitation space 21*b* toward the first gate 21*c*.

As illustrated in FIG. 4, as the developer concentrated on the second gate 21*d* is released toward the first gate 21*c*, the developer concentrated on the second gate 21*d* in the second agitation space 21*b* can smoothly pass through the second gate 21*d*. With this smooth circulation of the developer, the second auger 24 undergoes a reduction in rotation resistance and torque. Once the concentrated developer is released to some extent, the first and second augers 23 and 24 can be normally rotated in original rotation directions thereof.

Figure 5:
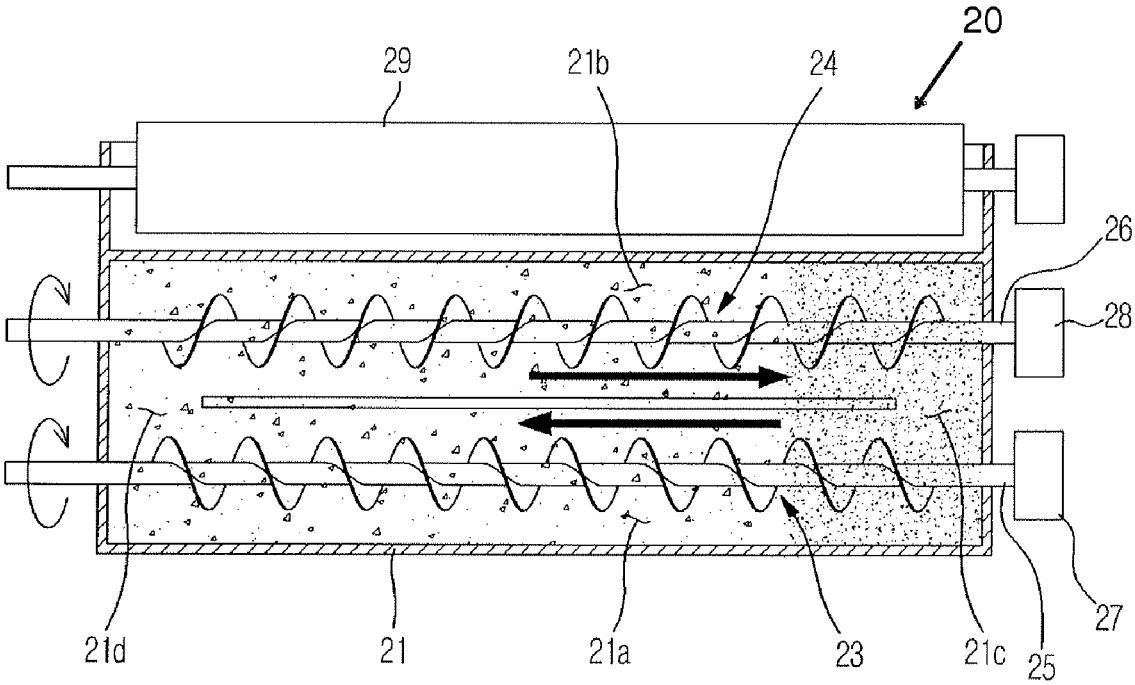
FIGS. 5 and 6 are views illustrating an operation to release developer concentrated on a right gate in the developing unit of the image forming apparatus according to an exemplary embodiment of the present general inventive concept.
Figure 6:
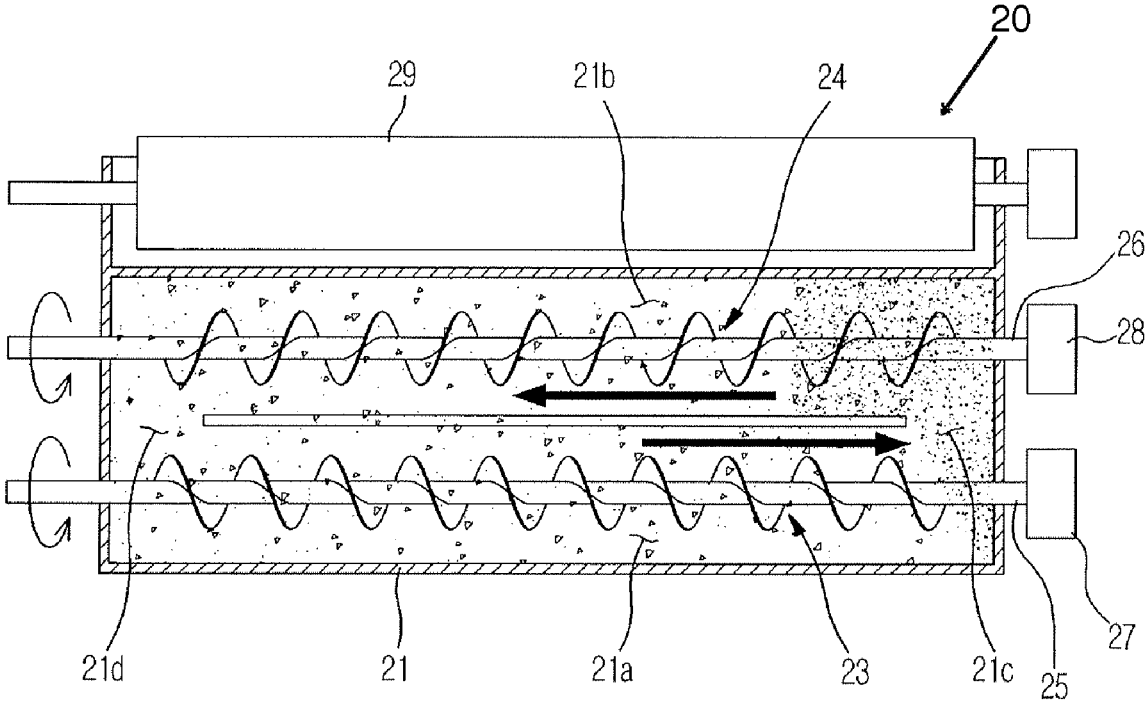

FIGS. 5 and 6 are views illustrating an operation to release developer concentrated on the right gate 21*c* in the developing unit 20 of the image forming apparatus 100 according to an exemplary embodiment of the present general inventive concept.

As illustrated in FIG. 5, if the developing unit 20 is initially operated in a state wherein the developer in the housing 21 is concentrated on the first gate 21*c*, the developer is accumulated at the first gate 21*c* rather than being delivered from the first agitation space 21*a* into the second agitation space 21*b* through the first gate 21*c*, thus increasing a delivery pressure in the first gate 21*c*, and consequently increasing a torque and load on the first auger 23 downstream of the first gate 21*c*. In this case, repeating an operation to rotate the first and second augers 23 and 24 forwardly and backwardly in sequence may deliver the developer concentrated on the first gate 21*c* in the first agitation space 21*a* toward the second gate 21*d*.

As illustrated in FIG. 6, as the developer concentrated on the first gate 21*c* is released toward the second gate 21*d*, the developer concentrated on the first gate 21*c* in the first agitation space 21*a* can smoothly pass through the first gate 21*c* to thereby be delivered into the second agitation space 21*b*. With this smooth circulation of the developer through the first gate 21*c*, the first auger 23 undergoes a reduction in rotation resistance and torque. Once the concentrated developer is released to some extent, the first and second augers 23 and 24 can be normally rotated in original rotation directions thereof.

In the exemplary embodiment described above, if the developer circulating between the first agitation space 21*a* and the second agitation space 21*b* is concentrated on the gate 21*c* or 21*d* defining a developer delivery passage between the two spaces 21*a* and 21*b* thus increases flow resistance, the augers 23 and 24 can repeat the forward and backward rotation to release the concentrated developer. The operation to release the concentrated developer may be implemented periodically, or may be implemented whenever the developing unit 20 is installed. However, in the case where the developing unit 20 is separated briefly from the image forming apparatus 100 and is reinstalled, there may occur a slight torque increase due to the concentration of the developer on the gate 21*c* or 21*d*. Therefore, it will be appreciated that implementing the forward and backward rotation when the developing unit 20 is initially installed into the body 11 of the image forming apparatus 100 is more effective to release developer from the gates 21*c* and/or 21*d* to permit a smooth flow of the developer. In this case, whether the developing unit 20 is initially installed or is reinstalled after being separated briefly from the image forming apparatus 100 may be determined as the controller 40 of the image forming apparatus 100 can confirm the status of the developing unit 20 by checking information in a memory device. The memory device can be contained in the developing unit 20, or it can be a memory device of the image forming apparatus 100.

Figure 7:
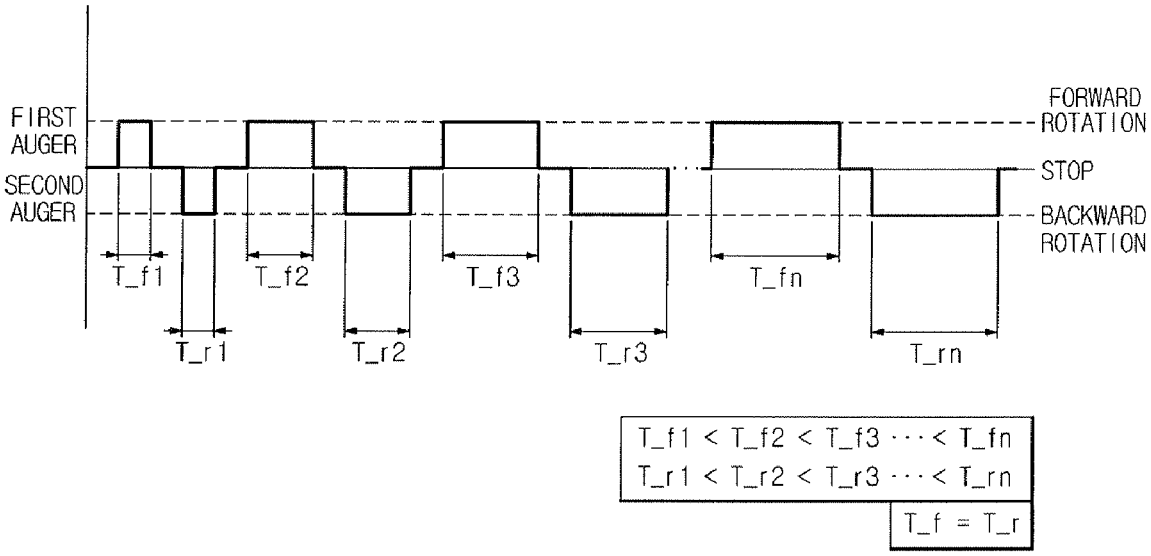
FIG. 7 is a view illustrating one exemplary forward and backward rotation time of first and second augers in the developing unit of the image forming apparatus according to an exemplary embodiment of the present general inventive concept.
Figure 8:
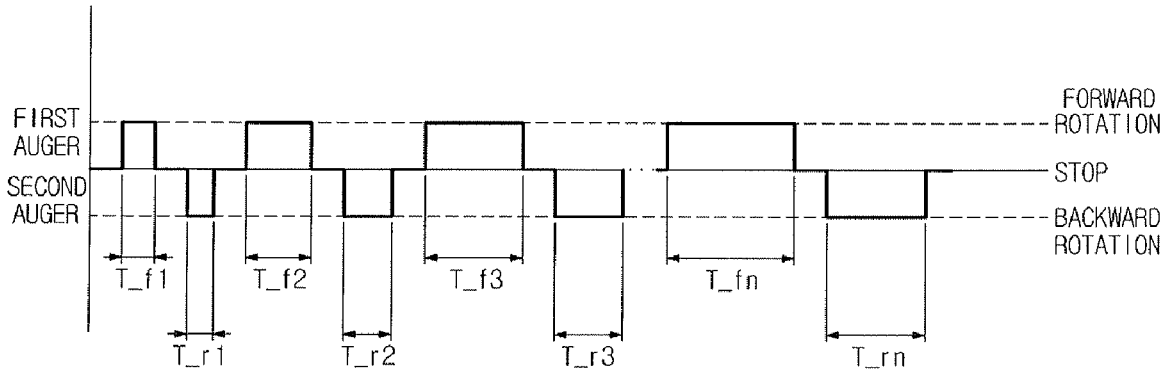
FIG. 8 is a view illustrating another exemplary forward and backward rotation time of the first and second augers in the developing unit of the image forming apparatus according to an exemplary embodiment of the present general inventive concept.

FIG. 7 is a view illustrating an exemplary forward and backward rotation time of the first and second augers 23 and 24 in the developing unit 20 of the image forming apparatus 100 according to an exemplary embodiment of the present general inventive concept. FIG. 8 is a view illustrating another exemplary forward and backward rotation time of the first and second augers 23 and 24 in the developing unit 20 of the image forming apparatus 100 according to another exemplary embodiment of the present general inventive concept.

As illustrated in FIG. 7, in an exemplary embodiment, to release the concentrated developer upon an initial operation of the developing unit 20, the forward and backward rotation of the first and second augers 23 and 24 can be repeated in such a manner that the first and second augers 23 and 24 are rotated forwardly for a time T_f and are stopped and thereafter, are rotated backwardly for a time T_r (where T_f=T_r) and can be stopped. As illustrated in FIG. 7, the forward rotation time and backward rotation time of the first and second augers 23 and 24 can be gradually increased as time passes under the control of the controller 40. For example, the forward and backward rotation of the first and second augers 23 and 24 can be controlled in a sequence of forward rotation for 5 ms→stop→backward→rotation for 5 ms→stop→forward rotation for 10 ms→stop→backward rotation for 10 ms→stop→forward rotation for 20 ms→stop→backward rotation for 20 ms→stop→forward rotation for 30 ms→stop→backward rotation for 30 ms→stop→ . . . →the beginning of a normal operation.

In another exemplary embodiment of the present general inventive concept, as illustrated in FIG. 8, although the forward rotation time and backward rotation time of the first and second augers 23 and 24 are gradually increased as time passes, the forward rotation time and backward rotation time may differ from each other. For example, the forward and backward rotation of the first and second augers 23 and 24 is controlled in the sequence of forward rotation for a time T_f1→stop→backward rotation for a time T_r1→stop→forward rotation for a time T_f2→stop→backward rotation for a time T_r2→stop→forward rotation for a time T_f3→stop→backward rotation for a time T_r3→stop→forward rotation for a time T_f4→stop→backward rotation for a time T_r4→stop→ . . . →the beginning of a normal operation. As illustrated in FIG. 8, T_f1≠T_r1, T_f2≠T_r2, T_f3≠T_r3, and T_f4≠T_r4. While FIG. 8 illustrates that T_f>T_r, this is only an example, and the durations of T_f and T_r can be varied, for example, so that T_f<T_r in some or all intervals.

Figure 9:
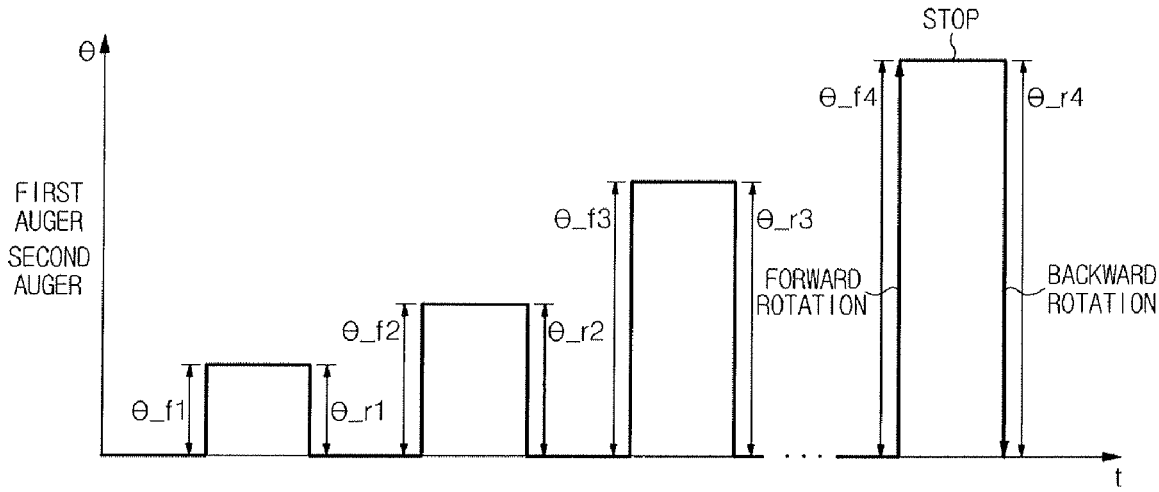
FIG. 9 is a view illustrating one exemplary forward and backward rotation angle of the first and second augers in the developing unit of the image forming apparatus according to an exemplary embodiment of the present general inventive concept.
Figure 10:
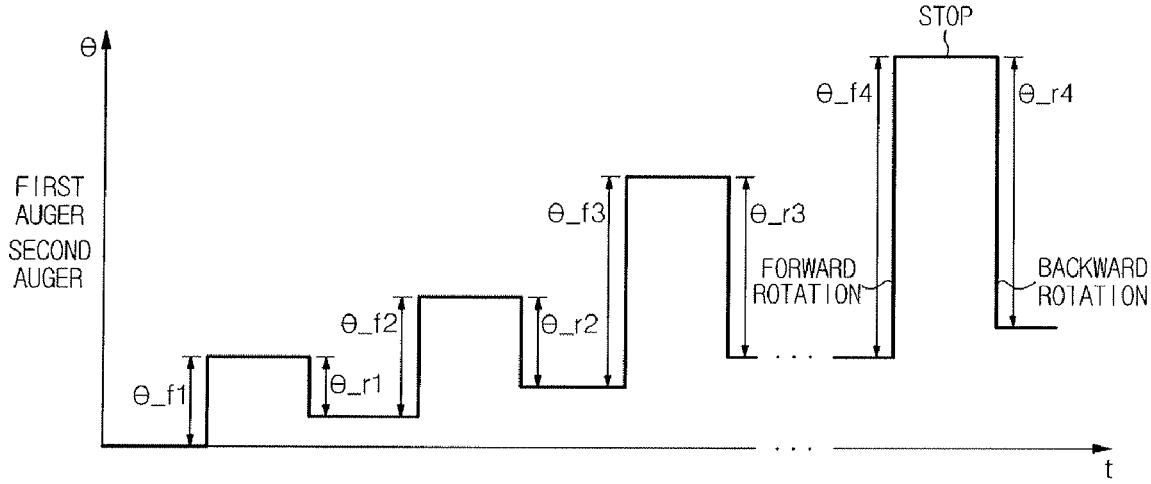
FIG. 10 is a view illustrating another exemplary forward and backward rotation angle of first and second augers in the developing unit of the image forming apparatus according to an exemplary embodiment of the present general inventive concept.

FIG. 9 is a view illustrating one exemplary forward and backward rotation angle of the first and second augers 23 and 24 in the developing unit 20 of the image forming apparatus 100 according to an exemplary embodiment of the present general inventive concept, and FIG. 10 is a view illustrating another exemplary forward and backward rotation angle of first and second augers 23 and 24 in the developing unit 20 of the image forming apparatus 100 according to an exemplary embodiment of the present general inventive concept.

As illustrated in FIG. 9, when the first and second augers 23 and 24 are rotated forwardly and backwardly to release the concentrated developer upon an initial operation of the developing unit 20, the first and second augers 23 and 24 can be rotated forwardly by an angle θ_f1 and can be stopped, and thereafter can be rotated backwardly by an angle θ_r1 (θ_r1=θ_f1) and can be stopped. In an exemplary embodiment, the forward rotation angle and backward rotation angle of the first and second augers 23 and 24 can be gradually increased as time passes under the control of the controller 40. For example, the forward and backward rotation of the first and second augers 23 and 24 can be controlled in a sequence of forward rotation by 15 degrees→stop→backward rotation by 15 degrees→stop→forward rotation by 30 degrees→stop→backward rotation by 30 degrees→stop→forward rotation by 60 degrees→stop→backward rotation by 60 degrees→stop→forward rotation by 90 degrees→stop→backward rotation by 90 degrees→stop→ . . . →the beginning of a normal operation.

In another exemplary embodiment of the present general inventive concept, as illustrated in FIG. 10, although the forward rotation angle and backward rotation angle of the first and second augers 23 and 24 can be gradually increased as time passes, the forward rotation time and backward rotation time may differ from each other. For example, the forward and backward rotation of the first and second augers 23 and 24 can be controlled in the sequence of forward rotation by θ_f1 degrees→stop→backward rotation by θ_r1 degrees→stop→forward rotation by θ_f2 degrees→stop→backward rotation by θ_r2 degrees→stop→forward rotation by θ_f3 degrees→stop→backward rotation by θ_r3 degrees→stop→forward rotation by θ_f4 degrees→stop→backward rotation by θ_r4 degrees→stop→ . . . →the beginning of a normal operation. As illustrated in FIG. 10, Θ_f1>Θ_r1, Θ_f2>Θ_r2, Θ_f3>Θ_r3, and Θ_f4>Θ_r4. However, this is not a limitation, and the rotation angles of Θ_f and Θ_r can be varied, for example, so that Θ_f<Θ_r in some or all instances.

Of course, in exemplary embodiments as illustrated in FIGS. 7 to 10, although the forward and backward rotation is not repeated with a gradually increased rotation time or rotation angle throughout the overall rotation sections, in a possible alternative embodiment, at least one rotation section may exhibit more increased rotation time or rotation angle than a previous rotation section.

Figure 11:
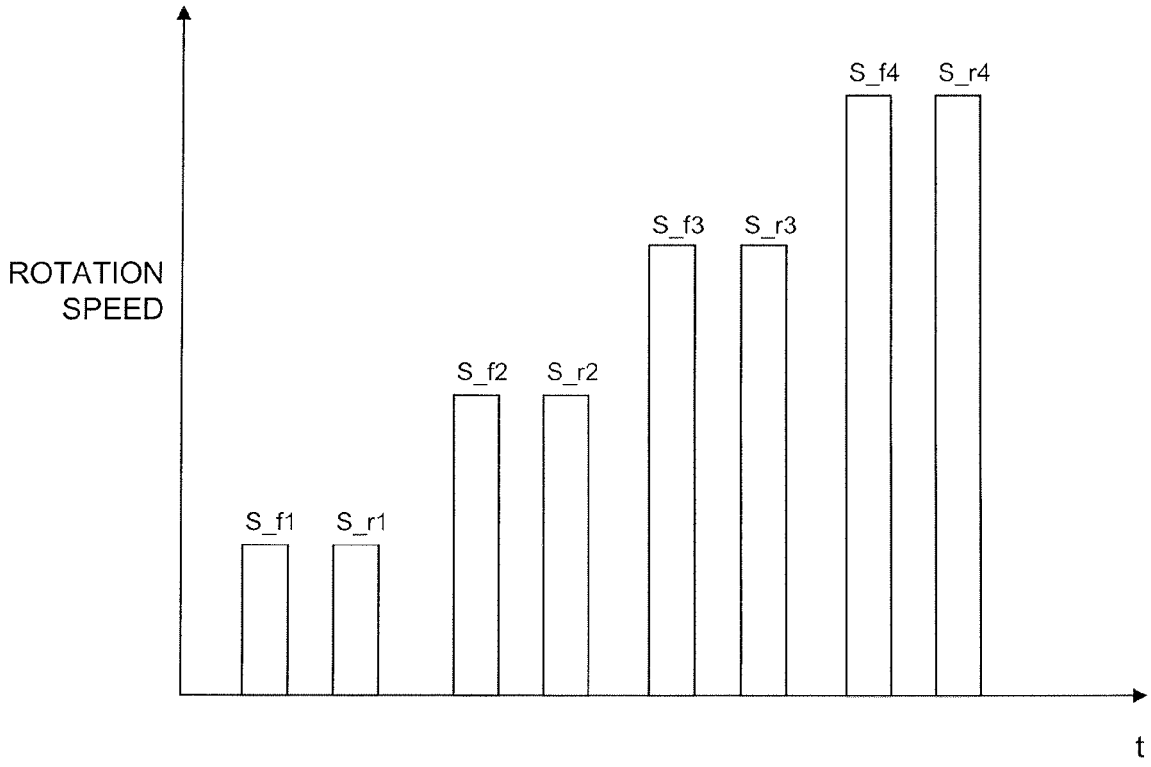
FIG. 11 is a view illustrating one exemplary forward and backward rotation speed of the first and second augers in the developing unit of the image forming apparatus according to an exemplary embodiment of the present general inventive concept.

In addition to the rotation time or rotation angle, a rotation speed may be changed. Specifically, the speed of forward and backward rotation may be gradually increased under the control of the controller 40 with the maintenance of a constant rotation time. As illustrated in FIG. 11, the rotation speed of the first and second augers 23 and 24 can be gradually increased over time under the control of the controller 40. For example, the forward and backward rotation speed of the first and second augers 23 and 24 can be controlled in a sequence of forward rotation at a speed S_f1→stop→backward rotation at a speed of S_r1→stop→forward rotation at a speed S_f2→stop→backward rotation at a speed of S_r2→stop→forward rotation at a speed S_f3→stop→backward rotation at a speed of S_r3→stop→forward rotation at a speed S_f4→stop→backward rotation at a speed of S_r4→stop. After the completion of the repeated forward and backward rotation, the augers 23 and 24 may be operated in a normal operation.

Figure 12:
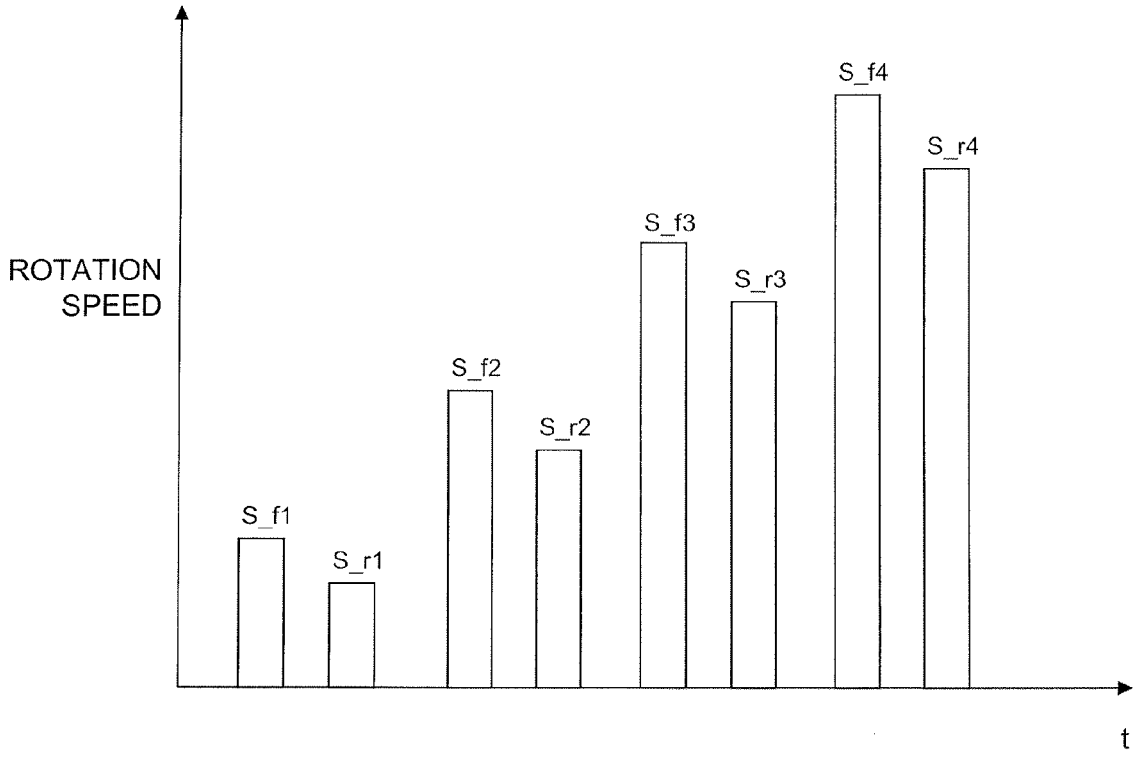
FIG. 12 is a view illustrating another exemplary forward and backward rotation speed of the first and second augers in the developing unit of the image forming apparatus according to an exemplary embodiment of the present general inventive concept.

In another exemplary embodiment, as illustrated in FIG. 12, the rotation speed of the first and second augers 23 and 24 can be gradually increased over time, and the rotation speeds of each of auger 23 and 24 can differ from each other. For example, the forward and backward rotation speeds of the augers 23 and 24 can be controlled in a sequence of forward rotation at a speed S_f1→stop→backward rotation at a speed of S_r1→stop→forward rotation at a speed S_f2→stop→backward rotation at a speed of S_r2→stop→forward rotation at a speed S_f3→stop→backward rotation at a speed of S_r3→stop→forward rotation at a speed S_f4→stop→backward rotation at a speed of S_r4→stop, where S_fx>S_rx. Although FIG. 12 illustrates that S_fx>S_rx, this is not a limitation, and the backward rotation speeds (S_r) may be greater than the forward rotation speeds (S_f) in some or all cases.

Alternatively, all of the rotation times, rotation speeds and rotation angles may naturally be controlled simultaneously in consideration of interrelationship therebetween. Here, the reason why the rotation speed, rotation time, or rotation angle is increased is to achieve a great torque upon an initial operation because the developer is mostly solidified and conglomerated when the developer unit 20 is initially installed in the image forming apparatus 100, or if the developer unit 20 has not been operated for a sufficient period of time in the image forming apparatus 100, or if the developer unit 20 has been separated from the image forming apparatus 100 and then reinstalled. Therefore, the controller initially control the drive source 30 to transmit a rotating force sufficient to operate the agitator, and thereafter gradually increase the rotation time, rotation speed and/or rotation angle because the solidified developer is released to some extent by an initial rotation of the agitator.

In exemplary embodiments of the present general inventive concept, the magnetic roller 29 is described by way of example, but this is not a limitation and the magnetic roller 29 may be implemented in other configurations, for example, as a rubber cylindrical developing roller or developing belt based on the configuration of the developing unit 20.

The control of the forward and backward rotation may be implemented upon an initial operation time of a detachable cartridge containing the agitator. Here, the initial operation time means a time when the agitator in the cartridge is initially rotated after installation of the cartridge, or a previous rotation time when the agitator is rotated at a print standby time in response to a print command transmitted to the image forming apparatus. In particular, the above-described operation may be implemented upon an initial installation time when the cartridge, which has been in a packed unused state, is initially installed into the image forming apparatus. In this case, whether or not the cartridge is initially installed may be determined from the image forming apparatus using a lifespan display device mounted to the cartridge. Here, the lifespan display device may take the form of a memory device containing data to indicate the initial installation. In this case, the controller of the image forming apparatus may read and determine the use information or lifespan information stored and contained in the memory device via an interface provided in the image forming apparatus. Alternatively, hardware or other mechanisms to indicate the initial installation may be provided. For example, a fuse may be short-circuited upon initial installation to indicate the initial installation. In addition, a memory of the image forming apparatus 100 cay store information indicating an initial installation of the cartridge. The lifespan of the cartridge may also be displayed on a display of the image forming apparatus 100.

The detachable cartridge is designed to allow a user or repairman to detach or attach the cartridge. In addition to the agitator as an essential element, the detachable cartridge can further contain the developer, developing device, photoconductor, charging device, etc., all these internal elements being selectively integrated or separably provided.

In summary, it can be determined upon operation of the developing unit 20 whether or not the developing unit 20 is initially operated after installation thereof. If the initial operation is determined, it can be determined whether the developer is concentrated on the first gate 21*c* or second gate 21*d* in the housing 21. Thereafter, the first and second augers 23 and 24 can be repeatedly rotated forwardly and backwardly to release the concentrated developer. After releasing the concentrated developer, the developing unit 20 can be normally operated. In addition, the repeated forward and backward rotation of the augers 23 and 24 can be performed at any time to release developer which is concentrated at the first gate 21*c* or the second gate 21*d*. For example, the operation to release the concentrated developer may be performed after the developer unit 20 is separated from the image forming apparatus and reinstalled, or the operation may be performed periodically, such as after a predetermined period of time since the previous performance of the operation.

As is apparent from the above description, according to exemplary embodiments of the present general inventive concept, when circulation of developer in a housing of a developing unit is deteriorated due to concentration of the developer, thus applying increased load to an agitator, the agitator can be appropriately rotated forwardly and backwardly under the control of a controller. This may prevent overloading of the agitator and may release the concentrated developer.

The present general inventive concept can also be embodied as computer-readable codes on a computer-readable medium. The computer-readable medium can include a computer-readable recording medium and a computer-readable transmission medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in distributed fashion. The computer-readable transmission medium can transmit carrier waves and signals (e.g., wired or wireless data transmission through the Internet). Also, functional programs, codes, and code segments to accomplish the present general inventive concept can be easily construed by programmers skilled in the art to which the present general inventive concept pertains.

Although a few exemplary embodiments have been illustrated and described, it will be appreciated by those skilled in the art that changes may be made in these exemplary embodiments without departing from the principles and spirit of the general inventive concept, the scope of which is defined in the claims and their equivalents.

What is claimed is:

1. An image forming apparatus comprising:

a housing in which an agitation space for agitation of a developer is defined;

an agitator rotatably provided in the agitation space to deliver the developer;

a developing device to feed the developer delivered by the agitator to a photoconductor;

a drive source to rotate the agitator; and a controller to control the drive source to rotate the agitator in a forward rotation and a backward rotation, the agitator being rotated forwardly and backwardly respectively at an initial operation time of the housing under the control of the controller.

2. The apparatus according to claim 1, wherein the controller controls the forward rotation of the agitator a different number of times from the backward rotation of the agitator at the initial operation time of the housing.

3. The apparatus according to claim 2, wherein the controller controls repeated implementation of the forward and backward rotation such that at least one of a rotation speed, a rotation time and a rotation angle of at least one of the forward rotation and backward rotation is changed at different rates with respect to the forward rotation and the backward rotation.

4. The apparatus according to claim 1, wherein the controller controls repeated implementation of the forward and backward rotation such that at least one of a rotation speed, a rotation time and a rotation angle of at least one of the forward rotation and backward rotation is changed.

5. The apparatus according to claim 2, wherein the controller controls repeated implementation of the forward and backward rotation such that at least one of a rotation speed, a rotation time and a rotation angle of at least one of the forward rotation and backward rotation is changed, causing an increase in the rotation speed, rotation time, or rotation angle as time passes.

6. The apparatus according to claim 1, wherein the initial operation time is at least one of a time when the housing is initially installed into the image forming apparatus, a time when the agitator is initially rotated after separation and reinstallation of the housing, and a previous operation time for a print operation in response to a print command transmitted to the image forming apparatus.

7. The apparatus according to claim 6, wherein the initial operation time is determined via information stored in a memory device of the housing or of the image forming apparatus.

8. The apparatus according to claim 1, wherein the agitator is configured into a shape including at least one of a spiral screw shape, a shape including at least one rotator in the form of a plate, a shape including at least one rotator in the form of a blade, or a hollow tube shape.

9. A control method of an image forming apparatus comprising a housing in which an agitation space for agitation of developer is defined, an agitator rotatably provided in the agitation space to deliver the developer, and a developing device to feed the developer delivered by the agitator to a photoconductor, the control method comprising:

determining whether or not the housing is initially operated; and implementing a forward and backward rotation of the agitator if the initial operation of the housing is determined.

10. The method according to claim 9, wherein the implementation of the forward and backward rotation of the agitator includes rotating the agitator forwardly and backwardly respectively one or more times.

11. The method according to claim 10, wherein the implementation of the forward and backward rotation of the agitator includes controlling the forward rotation a different number of times from the backward rotation.

12. The method according to claim 10, wherein the implementation of the forward and backward rotation of the agitator includes controlling repeated implementation of the forward and backward rotation such that at least one of a rotation speed, a rotation time and a rotation angle of at least one of the forward rotation and backward rotation is changed.

13. The method according to claim 12, wherein the implementation of the forward and backward rotation of the agitator includes controlling repeated implementation of the forward and backward rotation such that at least one of a rotation speed, a rotation time and a rotation angle of at least one of the forward rotation and backward rotation is changed, causing an increase in the rotation speed, rotation time, or rotation angle as time passes.

14. The method according to claim 12, wherein the implementation of the forward and backward rotation of the agitator includes controlling repeated implementation of the forward and backward rotation such that at least one of a rotation speed, a rotation time and a rotation angle of at least one of the forward rotation and backward rotation is changed at different rates with respect to the forward rotation and the backward rotation.

15. The method according to claim 10, wherein the initial operation time of the housing is at least one of a time when the housing is initially installed into the image forming apparatus, a time when the agitator is initially rotated after separation and reinstallation of the housing, and a previous operation time for a print operation in response to a print command transmitted to the image forming apparatus.

16. The method according to claim 15, wherein the initial operation time is determined via information stored in a memory device of the housing or of the image forming apparatus.

17. A cartridge provided in an image forming apparatus to form an image and having a drive source, the cartridge comprising:

an agitation space to receive a developer; and an agitator provided in the agitation space to agitate the developer, the agitator being operated by the drive source to implement a forward and backward rotation, and being rotated forwardly and backwardly respectively upon an initial operation of the cartridge.

18. The cartridge according to claim 17, further comprising:

a developing device to which the developer agitated by the agitator is fed; and a photoconductor to which the developer is fed by the developing device.

19. The cartridge according to claim 17, wherein the forward rotation and the backward rotation are performed a different number of times from each other upon the initial operation of the cartridge.

20. The cartridge according to claim 17, wherein the forward and backward rotation is repeated such that at least one of a rotation speed, a rotation time and a rotation angle of at least one of the forward rotation and backward rotation is changed.

* * * * *